United States Patent [19]

Goodall

[11] Patent Number: 5,002,209

[45] Date of Patent: Mar. 26, 1991

[54] POURING DEVICE HAVING A TUBULAR BODY AND A PLURALITY OF FLEXIBLY MOUNTED BREATHER/VENT TUBES

[76] Inventor: Donald T. Goodall, 30 Beach Street, Blakehurst N.S.W. 2221, Australia

[21] Appl. No.: 391,518

[22] PCT Filed: Nov. 28, 1988

[86] PCT No.: PCT/GB88/01035

§ 371 Date: Sep. 20, 1989

§ 102(e) Date: Sep. 20, 1989

[87] PCT Pub. No.: WO89/04797

PCT Pub. Date: Jun. 1, 1989

[30] Foreign Application Priority Data

Nov. 26, 1987 [GB] United Kingdom ..... 8727678

[51] Int. Cl.[5] ..... B65D 47/06

[52] U.S. Cl. ..... 222/479; 222/481.5; 222/566; 220/85 SP; 220/307

[58] Field of Search ..... 222/478–479, 222/481.5, 541, 566; 220/85 SP, 307

[56] References Cited

U.S. PATENT DOCUMENTS

| | | | |
|---|---|---|---|
| 880,669 | 3/1908 | Keller | 222/481.5 |
| 2,796,205 | 6/1957 | Kuzma | 222/479 X |
| 3,610,484 | 10/1971 | Matzka | 222/479 |
| 3,858,766 | 1/1975 | Schiemann | 222/479 |

FOREIGN PATENT DOCUMENTS

| | | | |
|---|---|---|---|
| 224863 | 6/1987 | European Pat. Off. | 222/478 |
| 1107108 | 5/1961 | Fed. Rep. of Germany | 222/478 |
| 1504809 | 10/1967 | France | 222/478 |
| 2480245 | 10/1981 | France . | |
| 8102720 | 10/1981 | World Int. Prop. O. . | |

*Primary Examiner*—Michael S. Huppert
*Assistant Examiner*—Kenneth R. DeRosa
*Attorney, Agent, or Firm*—Darby & Darby

[57] ABSTRACT

A pouring device for positioning in an outlet of a container, the pouring device comprising a tubular body which is arranged to be locatable in the container outlet and a series of breather tubes which are mounted around an end of the tubular body and extend away from the tubular body, the breather tubes being movable from a first position, at which the breather tubes are substantially axially aligned with the tubular body to a second position, at which the breather tubes are inclined to the axis of the tubular body.

21 Claims, 5 Drawing Sheets

POURING DEVICE HAVING A TUBULAR BODY AND A PLURALITY OF FLEXIBLY MOUNTED BREATHER/VENT TUBES

The present invention relates to a pouring device and in particular to a pouring device for use with a liquid container.

It is well known that it is difficult to obtain a smooth flow of liquid from a container having a single outlet. The outflow of liquid from the container creates a low pressure zone within the container. As a consequence of this, air is forced into the container through the liquid passing through the outlet and in so doing creates a surging or gulping effect. This surging effect disrupts the outflow producing an unstable jet of liquid.

In normal circumstances, such an unstable jet of liquid is merely inconvenient. However, when corrosive, toxic or flammable liquids are being poured from a container such an unstable flow can be dangerous.

In my earlier European Patent Specification No. 0047757 there is disclosed a pouring device which is provided with a pair of opposed legs which generally conform to the shape of the container outlet and are deformed inwardly when the device is fitted into a container outlet. The device also comprises a body portion having an aperture therethrough and an air flow tube in communication with the aperture. In use, a free end of the air flow tube is disposed within the container.

The present invention aims to provide an improved pouring device.

Accordingly, the present invention provides a pouring device for positioning in an outlet of a container, the pouring device comprising a tubular body which is arranged to be locatable in the container outlet and a series of breather tubes which are mounted around an end of the tubular body and extend away from the tubular body, the breather tubes being movable from a first position, at which the breather tubes are substantially axially aligned with the tubular body to a second position, at which the breather tubes are inclined to the axis of the tubular body.

Embodiments of the present invention will now be described by way of example only with reference to the accompanying drawings, in which.

Figure 1:
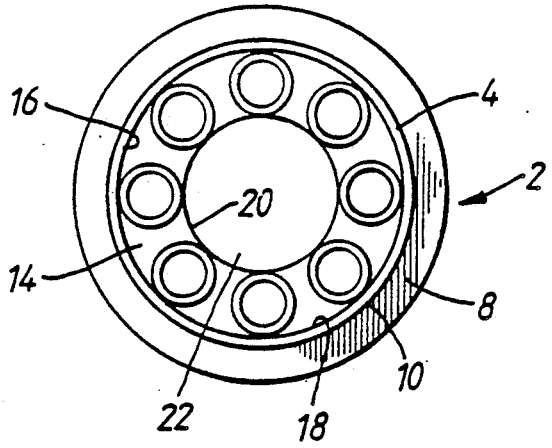
FIG. 1 is a plan view of a pouring device in accordance with a first embodiment of the present invention.
Figure 2:
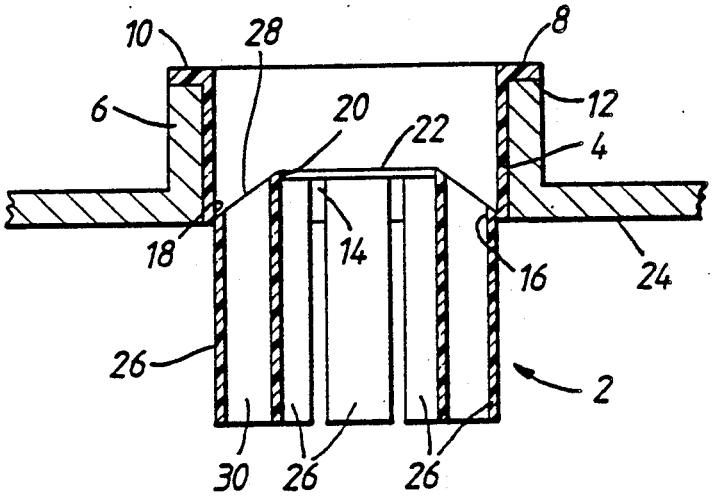
FIG. 2 is a sectional side view of the pouring device of FIG. 1 when inserted into a container outlet and with the breather tubes being aligned with the tubular body.

Referring to FIGS. 1 and 2, a pouring device 2 for positioning in an outlet of a container includes a tubular body 4 which is arranged to be locatable in the container outlet. The tubular body 4 is cylindrical and has an outer diameter which substantially corresponds to the inner diameter of a container outlet 6 into which the pouring device 2 is intended to be fitted. An annular flange 8 is provided at the outer annular edge 10 of the tubular body 4, which in use bears against a downstream end 12 of the container outlet 6 and acts as a stop when the pouring device 2 is fitted into the container outlet 6. The tubular body 4 is preferably of plastics. A frustoconical annular wall 14, having a shape similar to that of a Belleville washer and preferably of plastics, is attached by its outer circumferential edge 16 to the inner annular edge 18 of the tubular body 4. The inner circumferential edge 20 of the annular wall 14 defines a liquid-pouring bore 22 through which liquid is poured out of the container, the upper wall 24 of the container being shown in FIG. 2. The frustoconical annular wall 14 extends inwardly of the tubular body 4 and towards the outer annular edge 10 (i.e. in the downstream direction of liquid flow).

A series of breather tubes 26, preferably of plastics, are mounted around the annular wall 14 and extend away from the tubular body 4. Each breather tube 26 has an air inlet 28 in the annular wall 14 and an air outlet 30 remote from the annular wall 14. The breather tubes 26 are equally spaced circumferentially around the annular wall 14. The breather tubes 26 are substantially axially aligned with the tubular body 4 and lie within the outer diameter of the tubular body 4.

Figure 3:
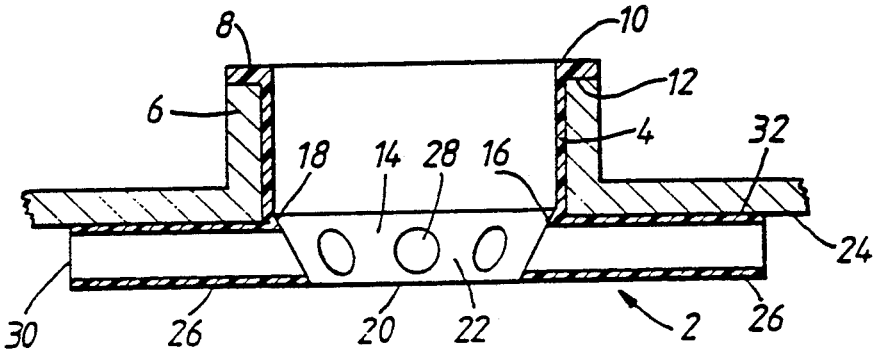
FIG. 3 is a sectional side view, similar to FIG. 2, wherein the annular wall of the pouring device has been flexed so as to dispose the breather tubes against the upper wall of the container.

The annular wall 14 is flexible whereby it can be deformed so as to extend away from the outer annular edge 10 (i.e. in the upstream direction of liquid flow). The annular wall 14 is thus "popped" from a first relaxed position, which is shown in FIG. 2, to a second relaxed position, which is shown in FIG. 3, via an intermediate elastically deformed configuration.

In the second relaxed position of the annular wall, the annular wall 14 is again frustoconical. In moving from the first to the second relaxed positions, at any given point the frustoconical surface of the annular wall 14 has been rotated through a right angle. This rotation of the annular wall 14 causes each of the breather tubes 26 attached thereto to be similarly rotated through a right angle. Thus, when the annular wall 14 is in the second relaxed position, shown in FIG. 3, the breather tubes 26 are in a second position transverse to the axis of the tubular body 4 and lie against the inner surface of the upper wall 24 of the container.

In the second position, the breather tubes 26 extend radially away from the axis of the liquid-pouring bore 22.

In use, the pouring device 2 is inserted into the container outlet 6 with the breather tubes 26 being aligned with the tubular body, as shown in FIG. 2. The flange 8 engages the outer annular edge 10 of the container outlet 6. The annular wall 14 is then pushed or "popped" downwardly into the container causing the breather tubes 26 to be rotated into their respective second positions transverse to the axis of the liquid-pouring bore 28. As the height of the tubular body 4 is substantially the same as that of the container outlet 6, the upper edges 32 of the breather tubes 26 lie against the container upper wall 24. The pouring device 2 is thereby firmly held within the container outlet 6 and is prevented from falling out. The container outlet 6 may be closed by means of a closure e.g. a threaded closure, (not shown).

Figure 4:
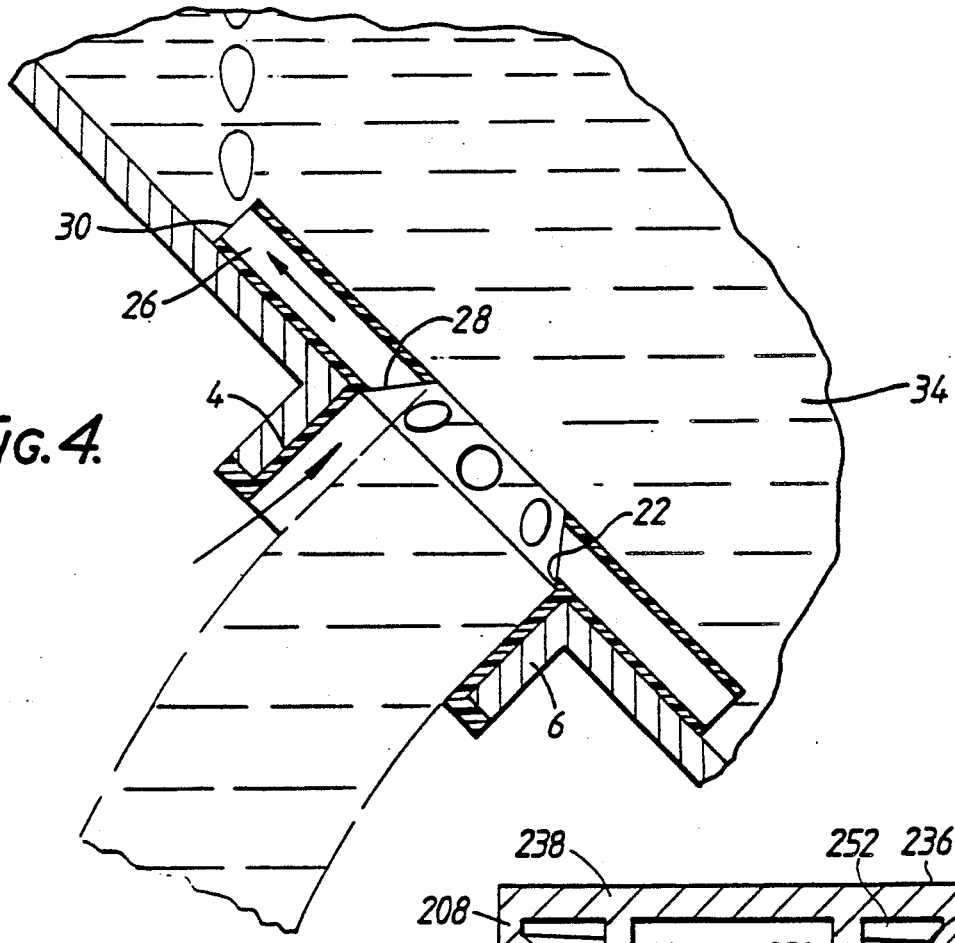
FIG. 4 is a sectional side view, similar to FIG. 3, showing the pouring device in operation when liquid is being poured from a container.

Referring to FIG. 4, when it is desired to pour liquid 34 from the container, the container is tipped to allow the liquid level to rise above the level of the liquid-pouring bore 22. The breather tubes 26 are arranged circumferentially around the liquid-pouring bore 22 and so at any given tipping inclination of the container one or more of the breather tubes 26 permits air to pass into the container through the one or more breather tubes 26 irrespective of the rotational position of the container, as shown by the arrows. At any rotational position of the container, at least one of the upwardly-directed breather tubes 26 permits an obstructed ingress of air into the container through the respective breather tube or tubes 26.

Figure 5:
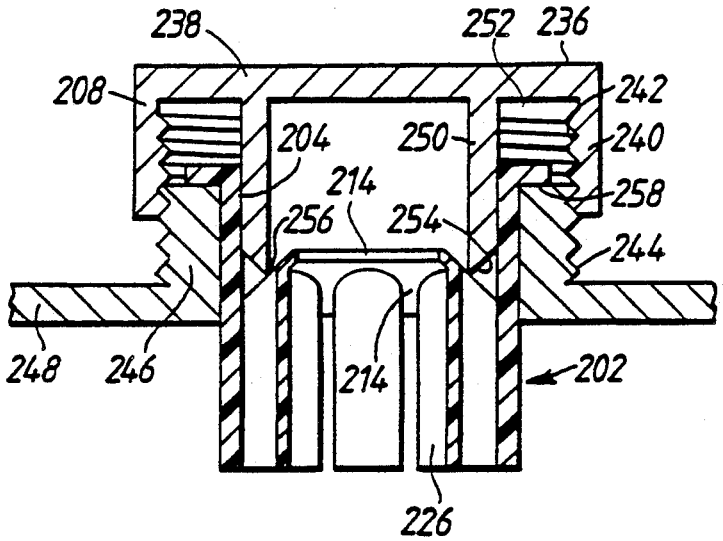
FIG. 5 is a sectional side view of a pouring device in accordance with a second embodiment of the present invention, the pouring device being mounted in a closure for a container, the pouring device being partly inserted into a container outlet.
Figure 6:
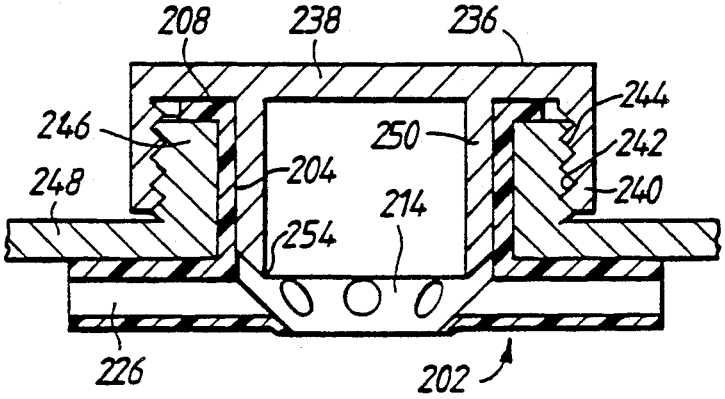
FIG. 6 is a sectional side view of the pouring device of FIG. 5 when fully inserted into a container outlet.

Referring to FIGS. 5 and 6, there is shown a pouring device 202 in accordance with a second embodiment of the present invention. The pouring device 202 has a construction the same as that of the embodiment of FIGS. 1 to 4, but is mounted on a removable closure 236 for a container. The closure 236 comprises a top wall 238 from which depends a cylindrical outer skirt 240 which is provided with a thread 242 on its inner cylindrical surface. The thread 242 is adapted to mate with a corresponding thread 244 on an upstanding cylindrical outlet 246 of a container 248. The closure 236 also comprises a cylindrical inner skirt 250 which depends from the top wall 238 and is concentric with the outer skirt 240. The outer diameter of the inner skirt 250 is substantially the same as the inner diameter of the tubular body 204. The tubular body 204 is slidably mounted around the inner skirt 250, but is frictionally held thereon by the action of the outer cylindrical surface of the inner skirt 250 engaging the inner cylindrical surface of the tubular body 204. A gap 252 is present between the annular flange 208 on the tubular body 204 and the top wall 238 of the closure 236. The annular end 254 of the skirt 250 is frustoconical and is inclined inwardly towards the axis of the closure 236. The lower (inner}annular edge 256 of the inner skirt 250 engages the annular wall 214 of the pouring device 202.

In use, the combination of the closure 236 and the pouring device 202 is attached onto the container outlet in a single step. As is shown in FIG. 5, the breather tubes 226 and the tubular body 204 are passed through the outlet 246 and the closure 236 is threaded onto the outlet 246. After the closure 236 is threaded onto the outlet 246 by a sufficient amount such that the flange 208 engages the downstream end 258 of the container outlet 246, further threading of the closure 236 onto the outlet 246 causes relative sliding movement between the closure 236 and the pouring device 202. The tubular body 204 slides upwardly further onto the inner skirt 250 thereby closing the gap 252. The annular edge 256 of the inner skirt 250 is pushed against the annular wall 214 and thereby flexes it, causing the annular wall 214 to be pushed downwardly into the container 248. This causes the annular wall 214 to be "popped" or "flipped" into its second relaxed position as shown in FIG. 6 when the closure 236 has been fully threaded onto the outlet 246. In this position, the breather tubes 226 have been urged radially outwardly and lie against the container upper wall. The upper flange 208 is squeezed between the top wall 238 of the closure 236 and the downstream end 252 of the container outlet 246. The end 254 of the inner skirt 250 lies against the annular wall 214. In this way, the pouring device 202 is located in the position in the container outlet 246. The closure 236 may be removed and replaced as des&red while the pouring device remains located within the container outlet.

This embodiment affords a very convenient means for inserting the pouring device into the container outlet. This is done automatically by application of the closure, on which the pouring device is carried, onto the container outlet.

It will be understood that the closure need not be threaded. The closure may be fixed in the container outlet by any other suitable means e.g. by a push-fit.

Figure 7:
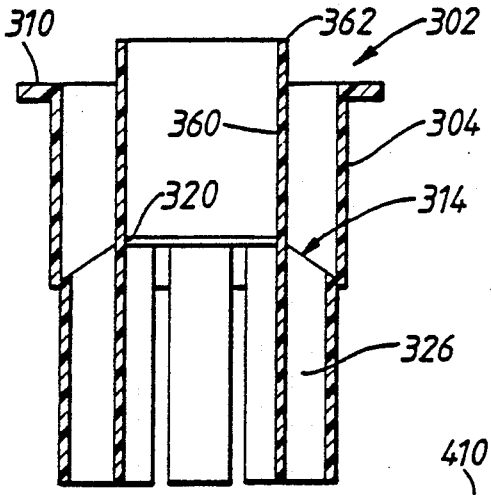
FIG. 7 is a sectional side view of a pouring device in accordance with a third embodiment of the present invention.

FIG. 7 shows a pouring device in accordance with a third embodiment of the present invention. In this embodiment, the pouring device is 302 is substantially the same as that of the first embodiment but is additionally provided with an inner tubular wall 360 which is concentric with the tubular body 304 and is connected to, and extends upwardly away from, the inner circumferential edge 320 of the annular wall 314. When the breather tubes 326 are aligned with the axis of the tubular body 304, the free end 362 of the inner tubular wall 360 extends above the outer annular edge 310 of the tubular body 304. In use, the tubular body 304 is fitted into an outlet for a container in the manner shown in FIG. 2. When the closure, e.g. a threaded cap (not shown) is applied to the outlet, the closure pushes the free end 362 of the inner tubular wall 360 downwardly into the container outlet. This causes flexing of the annular wall 314 so as to flip the breather tubes 326 into the second position in which the breather tubes 326 are transverse to the axis of the tubular body 304. Thus the provision of the inner tubular wall 360 acting as an extension above the container outlet facilitates the insertion of the pouring device 302 into the container outlet.

There is no need for the closure to include an inner skirt as shown in FIGS. 5 and 6.

Figure 8:
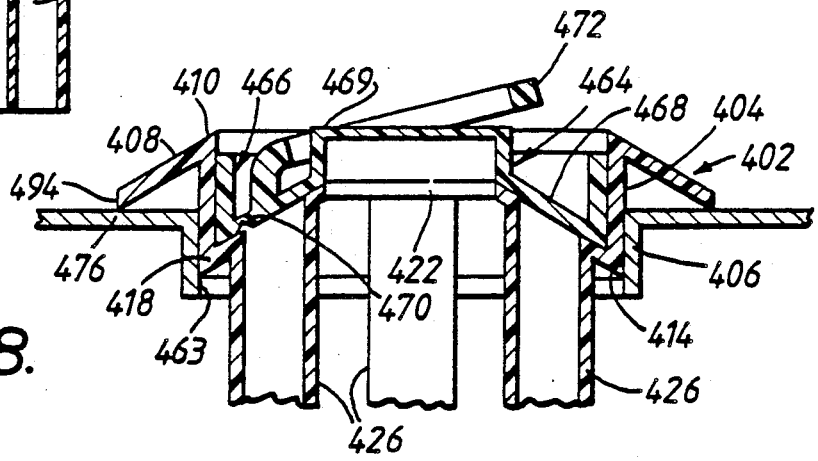
FIG. 8 is a sectional side view of a pouring device in accordance with a fourth embodiment of the present invention, the pouring device being partially inserted into a container outlet.
Figure 9:
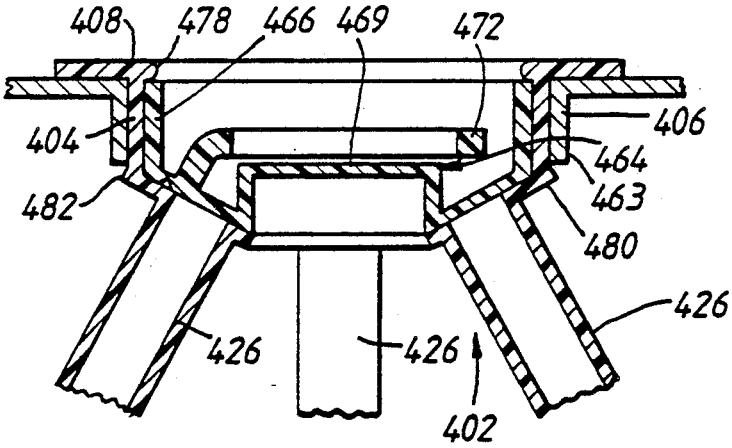
FIG. 9 is a sectional side view, similar to FIG. 8, wherein the pouring device has been fully inserted into a container outlet.

A fourth embodiment of the present invention is shown in FIGS. 8 and 9. The pouring device 402 includes a tubular body 404 which is insertable into a container outlet 406, the illustrated container outlet 406 comprising a simple rolled back edge opening 463 of a metal container. However, the embodiment could also be inserted into a screwed neck fitting in a plastics or metal container using an independent screw cap as a closure. A frusto-conical annular wall 414 is connected to the inner circular edge 418 of the tubular body 404 and has breather tubes 426 extending away therefrom. The outer annular edge 410 of the tubular body 404 has provided therearound a frusto-conical annular flange 408 which prior to insertion of the pouring device 402 into the container outlet 406 is inclined at an acute angle to the tubular body 404 and extends downwardly towards the breater tubes 426. A sealing diaphragm 464 is disposed inside the tubular body 404 and above the annular wall 414. The sealing diaphragm 464 comprises an outer ring 466 which is disposed against the inner circumferential surface of the tubular body 404. An integral frusto-conical sealing wall 468 extends upwardly away from the outer ring 466 towards an integral sealing cap 469. The sealing wall 468 is disposed against the upper surface of the annular wall 414 and the sealing cap 468 is disposed above the liquid pouring bore 422 of the annular wall 414. The sealing cap 469 extends above the upper circular edge 410 of the tubular body 404. A frangible line 470 is provided in the sealing wall 468 in the region of the outer ring 466. An integral pull ring 472 extends upwardly away from the sealing wall 468 and is disposed around the sealing cap 469. As will be described hereinbelow, the sealing diaphragm 464 constitutes a tamper evident feature wherein the pull ring 472 can be pulled away from the pouring device 402 thereby tearing along the frangible line 470 and pulling the sealing wall 468 and the sealing cap 469 away from the annular wall 414. This unseals the liquid pouring bore 422 and the breather tubes 426.

FIG. 8 shows the pouring device 402 when partially inserted into the container outlet 406 and with the outer annular edge 474 of the annular flange 408 disposed against the outer surface 476 of the container. In this position, the pouring device 402 is in a relaxed condition. In order to insert the pouring device 402 fully into the container outlet 406, the pouring device 402 is pushed inwardly into the container outlet 406. This causes the annular flange 408 to be deformed so that it is substantially at right angles to the axis of the tubular body 404 and, in addition, the sealing cap 469 is pushed inwardly so that the annular wall 414 and the sealing wall 468 are each flipped into a downwardly projecting position wherein the sealing cap 469 is disposed below the annular flange 408. The resultant deformed position is shown in FIG. 9 wherein the breather tubes 426 are inclined to the axis of the tubular body 404. The deformation of the annular flange 408 and the sealing diaphragm 464 results in the formation of an inwardly directed annular bead 478 of material which extends inwardly of the tubular body 404 and acts to lock the outer ring 466 of the sealing diaphragm 464 into the tubular body 404. In addition, the deformation results in the lower part 480 of the tubular body 404 being disposed below the rolled back edge opening 463 of the container and being deformed radially outwardly to form an outwardly-directed conically-shaped sealing bead 482. The deformation of the annular flange 408 causes the sealing bead 482 to be pulled upwardly into close engagement with the annular edge of opening 463. The bead 482 extends radially outwardly of the opening 463 thereby to form an effective liquid seal between the pouring device 402 and the opening 463. A specific additional advantage of this embodiment is that, in particular in combination with a rolled back edge in the opening 463 of a metal container, the bead 482 also can act to resist hydraulic forces generated within the container, particularly during pouring of liquid out of the container, which would tend to push the pouring device 402 out of the container opening 463. The provision of the bead 482 in the pouring device 402 in the container opening 463 can also act to counteract the effect of differential thermal expansion of the metal to plastic sealing surfaces.

The assembly of FIG. 9 may additionally be provided with any suitable type of closure. When it is desired to open the container, the closure is removed and the pull ring 472 is pulled away thereby to open the liquid pouring bore 422 and the ends of the breather tubes 426.

Figure 10:
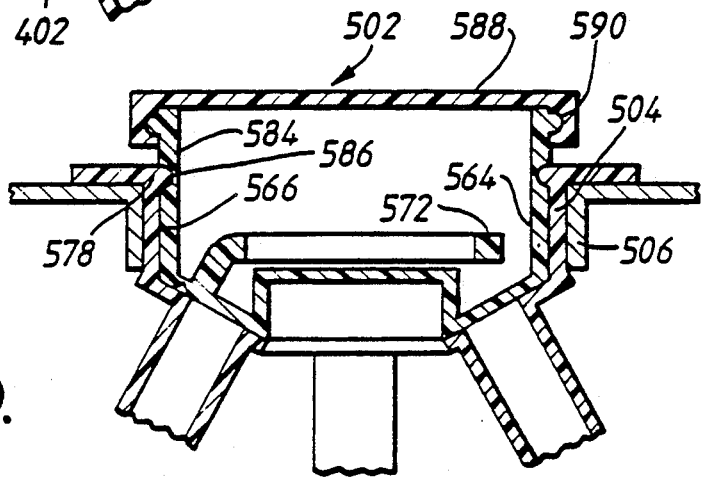
FIG. 10 is a sectional side view of a pouring device in accordance with a fifth embodiment of the present invention, the pouring device being fully inserted into a container outlet.

FIG. 10 shows a modification of the pouring device of FIG. 9. The pouring device 502 of FIG. 10 has substantially the same construction as that of FIG. 9 except that the outer ring 566 of the sealing diaphragm 564 is extended upwardly so as to form an extension 584 above the container outlet 506. The outer ring 566 includes an annular depression 586 in which the bead 578, at the outer edge of the tubular body 504, is received so as to retain the sealing diaphragm 564 in position. The top of the extension 584 is covered by a cap 588 which is press-fitted thereonto and held in position by a cooperating annular bead/annular depression arrangement 590. Alternatively, the cap 588 may be threaded onto the extension 584. The cap 588 can be removed as desired in order to access the pull ring 572 which can be pulled away to open the container.

Figure 11:
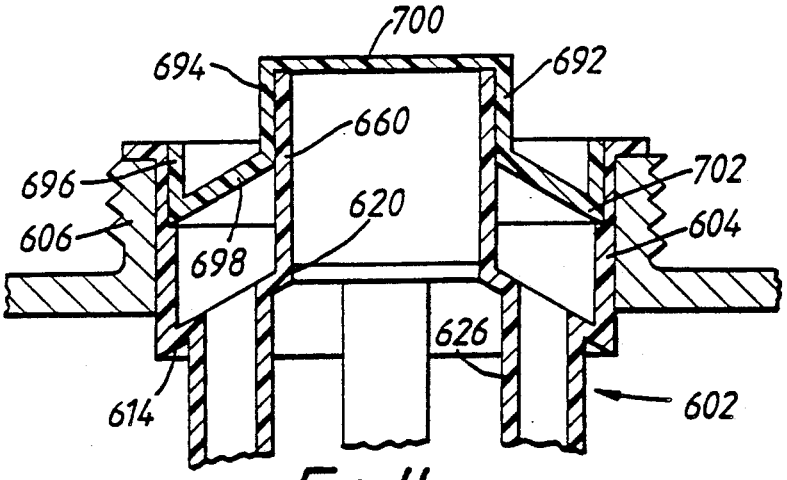
FIG. 11 is a sectional side view of a pouring device in accordance with a sixth embodiment of the present invention, the pouring device being inserted into a container outlet and with the breather tubes being aligned with the tubular body.
Figure 12:
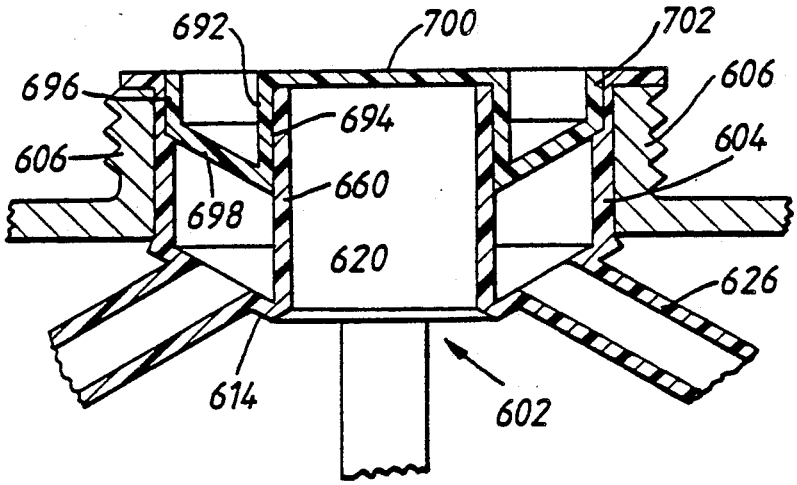
FIG. 12 is a sectional side view, similar to FIG. 11, wherein the annular wall of the pouring device has been flipped so as to incline the breather tubes relative to the axis of the tubular body.

FIGS. 11 and 12 show a further embodiment of the present invention in which the pouring device 602 is similar to that of the embodiment of FIG. 7 and includes an inner tubular wall 660. The inner tubular wall 660 extends upwardly away from the inner circumferential edge 620 of the annular wall 614. The pouring device 602 is additionally provided with a tear-out sealing diaphragm member 692. The diaphragm member 692 includes concentric inner and outer cylindrical walls 694, 696 connected together by a frusto-conical annulus 698 and a cap 700 which covers the free end of the inner tubular wall 660. The inner cylindrical wall 694 surrounds the inner tubular wall 660 and the outer cylindrical wall 696 is held in an internal recess 702 in the upper part of the tubular body 604. In the first position, as shown in FIG. 11, in which the breather tubes 626 are aligned with the axis of the tubular body 604, the annular wall 614 is in an upwardly pointed orientation and the annulus 698 of the diaphragm member 692 is parallel thereto. The tubular body 604 is received within a threaded container outlet 606. In the second position, as shown in FIG. 12, in which the annular wall 614 has been flipped downwardly as a result of pressure having been applied to the inner tubular wall 660 thereby to orient the breather tubes 626 so that they are inclined to the axis of the tubular body 604, the diaphragm member 692 has been similarly flipped into an orientation wherein the frustoconical annulus 698 points downwardly and the cap 700 is aligned with the top of the container outlet 606. The final orientation of the diaphragm member 692 results in a radially outwardly directed force which is applied to the tubular body 604 by the diaphragm member 692. The radial force is caused by the flipping of the frustoconical annulus 698 which flips the annulus into a stressed orientation which is constrained by the tubular body 604. The radial force is transmitted from the diaphragm member 692 through the tubular body 604 whereby the tubular body 604 is pressed against the inner surface of the container outlet 606. This provides an additional seal around the container outlet 606.

Figure 13:
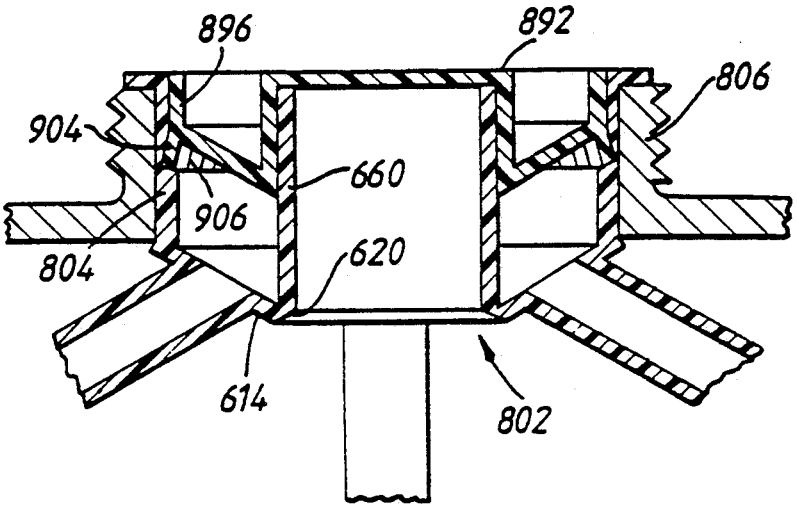
FIG. 13 is a sectional side view of a pouring device in accordance with a seventh embodiment of the present invention, the pouring device being inserted into a container outlet.

FIG. 13 shows a modification of the embodiment of FIGS. 11 and 12 wherein in the pouring device 802 the outer cylindrical wall 896 of the sealing diaphragm member 892 includes a downwardly directed skirt 904. The skirt 904 is segmented by a series of axially directed cuts 906. FIG. 13 shows the arrangement in the second position. The radial force acting on the outer cylindrical wall 896 as described hereinabove causes the skirt 904 to be pressed outwardly against the tubular body 804. The segmented nature of the skirt 904 permits an increase in radial diameter which in turn permits the skirt 904 to be pressed into the surface of the tubular body 804. It should be noted that for the purpose of clarity of illustration the FIG. exaggerates the increase in diameter. The increase in diameter of the skirt 904 causes an increased sealing pressure to be applied between the tubular body 804 and the container outlet 806.

Figure 14:
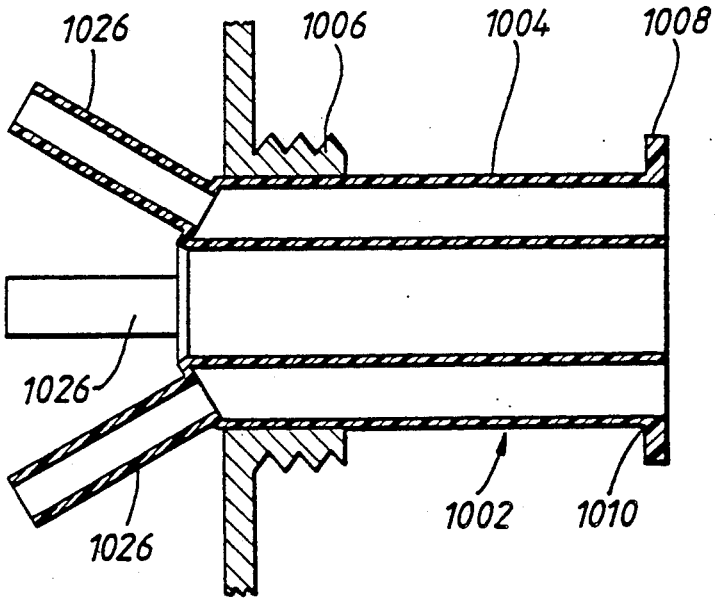
FIG. 14 is a part-sectional side view of a pouring device in accordance with an eighth embodiment of the present invention.

FIG. 14 shows a further embodiment of the present invention which is a modification of the embodiment of FIG. 7. In this further embodiment, the pouring device 1002 is provided with breather tubes 1026 which, in the second position, are inclined, but not at right angles to, the axis of the tubular body 1004. The tubular body 1004 is provided with an annular flange 1008 at is outer annular edge 1010. The axial length of the tubular body 1004 is arranged to be greater than the length of the container outlet 1006. With this embodiment, when the pouring device 1002 is fully inserted into the container outlet 1006, the flange 1008 can be manually gripped and pulled away from the container outlet 1006. The resultant configuration is shown in FIG. 14. Thus the pouring device 1002 can constitute an extension nozzle which enables the flow of liquid to be directed well away from the body of the container.

Figure 15:
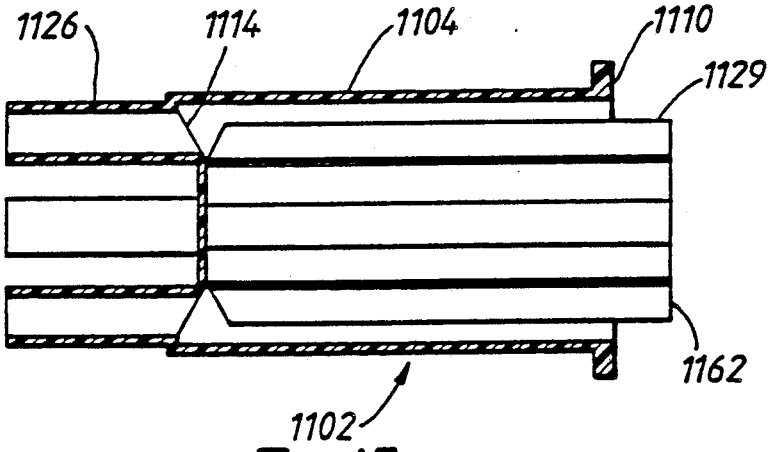
FIG. 15 is a part-sectional side view of a pouring device in accordance with a ninth embodiment of the present invention.
Figure 16:
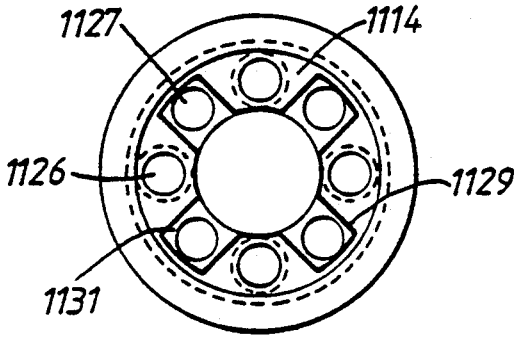
FIG. 16 is an end view of the pouring device of FIG. 15.

FIGS. 15 and 16 show a still further embodiment of the present invention wherein the pouring device 1102 is provided with only four breather tubes 1126 equally spaced around the frustoconical annular wall 1114. The frustoconical annular wall 1114 is also provided with four openings 1127 each of which is disposed between a respective pair of breather tubes 1126. A central tube 1129 in the form of a hollow cruciform extends away from the annular wall 1114 towards the outer annular edge 1110 of the tubular body 1104. The central tube 1129 is positioned such that each of the four arms 1131 of the cruciform communicates with a respective opening 1127 in the annular wall 1114 and the exits of the breather tubes 1126 are disposed between respective adjacent arms 1131 of the cruciform. The central tube 1129 has a length, relative to that of the tubular body 1104 which is similar to that of the inner tubular wall of the embodiment of FIG. 7. Thus, in the first position the free end 1162 of the central tube 1129 extends above the tubular body 1104 and the free end 1162 can be pushed inwardly e.g. by application of a screw cap until it is flush with or below the outer annular edge 1110 of the tubular body 1104 in order to dispose the breather tubes 1126 in the second position.

The use of a hollow cruciform or finned tube optimises the use of the available cross section area of the pouring device for liquid discharge. The present inventor has discovered that with pourers for small openings, it is necessary to minimise the resistance to liquid flow and consequently in this embodiment the number of breather tubes is reduced in order to increase the available openings for liquid flow out of the container. In addition, the cruciform central tube also assists the liquid flow rate by increasing the static liquid head differential between air getting into the container at the top of that working breather tube which is the most upwardly disposed and the liquid discharging form the cruciform central tube. The cruciform central tube may be a separate moulded part which is subsequently attached to the annular wall.

The pouring device of the present invention provide an advantage over my earlier pouring device in that it can provide gulp-free pouring at any rotational orientation of the container. The pouring device is securely held in the container outlet. The pouring device can easily be manufactured from moulded plastics.

I claim:

1. A pouring device for positioning in an outlet of a container, the pouring device comprising:

a tubular body for positioning in the container outlet;

a series of breather tubes flexibly mounted around an end of the tubular body by wall means interconnecting the tubular body and the breather tubes, the breather tubes extending away from the tubular body and movable between a first position at which the breather tubes are substantially axially aligned with the tubular body and a second positions at which the breather tubes are inclined to the axis of the tubular body.

2. A pouring device according to claim 1, wherein the wall means comprises a flexible annular wall attached between said breather tubes and the tubular body, each breather tube having an air inlet in the annular wall, the breather tubes being movable from the first position to the second position by flexing of the annular wall.

3. A pouring device according to claim 2, wherein the annular wall is frustoconical with an outer circumferential edge which is attached to the tubular body and an inner circumferential edge which defines a liquid-pouring bore.

4. A pouring device according to claim 2, wherein the breather tues are qualyspaced circumferentially around the annular wall.

5. A pouring device according to claim 2, wherein when the annular wall is flexed to dispose the breather tubes in the second position, the breather tubes are transverse to the axis of the tubular body.

6. A pouring device according to claim 2, further comprising a liquid pouring bore and a diaphragm member disposed adjacent the annular wall a nd covering the air inlets of the breather tubes, the diaphragm member being frangible to permit the air inlet and the liquid pouring bore of the pouring device to be opened.

7. A pouring device according to claim 2, further comprising a tubular extension mounted on the annular wall and having a free end extending away from the breather tubes, the breather tubes being movable from the first position to the second position by application of pressure to the free end of the tubular extension.

8. A pouring device according to claim 7, further comprising a liquid pouring bore defined by said inner edge of said annular wall, and a diaphragm member extending over the free end of the tubular extension and engaging in inner surface of the tubular body, the diaphragm member including a flexible annulus which covers the air inlets of the breather tubes and the liquid pouring bore, the diaphragm member being removable so as to permit the pouring device to be opened.

9. A pouring device according to claim 8, wherein the flexible annulus is frustoconical and is parallel to but spaced from the annular wall.

10. A pouring device for positioning in an outlet of a container, the pouring device comprising:

a tubular body for positioning in the container outlet;

a series of breather tubes flexibly mounted around an end of the tubular body by wall means interconnecting the tubular body and the breather tubes, the breather tubes extending away from the tubular body and movable between a first position at which the breather tubes are substantially axially aligned with the tubular body, and a second position at which the breather tubes are inclined to the axis of the tubular body;

the wall means comprising a frustoconical annular wall with its outer circumference attached to the tubular body and an inner circumferential edge which defines a liquid pouring bore;

each breather tube having an air inlet in the wall and flexing of said wall causing movement between said first and second positions.

11. A pouring device according to claim 10, wherein the breather tubes are equally spaced circumferentially around the annular wall.

12. A pouring device according to claim 10, wherein when the annular wall is flexed to dispose the breather tubes in the second position, the breather tubes are transverse to the axis of the tubular body.

13. A pouring device according to claim 10, further comprising a diaphragm member adjacent the annular wall and covering the air inlets of the breather tubes, the diaphragm member being frangible to permit the air inlet and the liquid pouring bore of the pouring device to be opened.

14. A pouring device according to claim 10, further comprising a tubular extension mounted on the annular wall nd having a free end extending away from the breather tubes, the breather tubes being movable from the first position to the second position by application of pressure to the free end of the tubular extension.

15. A pouring device according to claim 14, further comprising a diaphragm member extending over the free end of the tubular extension and engaging an inner surface of the tubular body, the diaphragm member including a flexible annulus which covers the air inlets of the breather tubes and the liquid pouring bore of the pouring device, the diaphragm member being removable so as to permit the pouring device to be opened.

16. A pouring device according to claim 15, wherein the flexible annulus is frustoconical and is parallel to but spaced from the annular wall.

17. A pouring device according to claim 16, wherein the breather tubes are equally spaced circumferentially around the annular wall.

18. A pouring device according to claim 16, wherein when the annular wall is flexed to dispose the breather tubes in the second position, the breather tubes are transverse to the axis of the tubular body.

19. A pouring device for positioning in an outlet of a container, the pouring device comprising:

a tubular body for positioning in the container outlet;

a series of breather tubes flexibly mounted around an end of the tubular body by wall means interconnecting the tubular body and the breather tubes, the breather tubes extending away from the tubular body and movable between a first position at which the breather tubes are substantially axially aligned with the tubular body, and a second position at which the breather tubes are inclined to the axis of the tubular body;

the wall means comprising a frustoconical annular wall with its outer circumference attached to the tubular body and an inner circumferential edge which defines a liquid pouring bore;

each breather tube having an air inlet in the wall, said wall being subject to flexing, and said flexing of said wall causing movement of said tubes between said first and second positions.

20. A pouring device according to claim 19, further comprising a diaphragm member engaging an inner surface of the tubular body, the diaphragm member including a flexible annulus which covers the air inlets of the breather tubes and the liquid pouring bore of the pouring device, the diaphragm member being removable so as to permit the pouring device to be opened.

21. A pouring device according to claim 20, wherein the flexible annulus is frustoconical and is parallel to but spaced from the annular wall.

* * * * *